US005133511A

United States Patent [19]

Mack et al.

[11] Patent Number: 5,133,511

[45] Date of Patent: Jul. 28, 1992

[54] APPARATUS FOR THE EDGE ALIGNED CONNECTION OF WEBS

[75] Inventors: Horst Mack, Augsburg; Alois Steinhardt, Bobingen, both of Fed. Rep. of Germany

[73] Assignee: Erhardt & Leimer GmbH, Augsburg, Fed. Rep. of Germany

[21] Appl. No.: 586,790

[22] Filed: Sep. 21, 1990

[30] Foreign Application Priority Data

Sep. 23, 1989 [DE] Fed. Rep. of Germany ..... 3931852

[51] Int. Cl.[5] ..... B65H 19/00

[52] U.S. Cl. ..... 242/57.1; 242/58.1

[58] Field of Search ..... 242/57, 57.1, 58.58.1

[56] References Cited

U.S. PATENT DOCUMENTS

| | | | |
|---|---|---|---|
| 3,085,762 | 4/1963 | Subklew | 242/58 |
| 3,279,716 | 10/1966 | Huck | 242/57 |
| 3,391,877 | 7/1968 | Angel et al. | 242/57 |
| 4,466,577 | 8/1984 | Folke et al. | 242/58.1 X |
| 4,543,152 | 9/1985 | Nozaka | 242/57 X |
| 4,564,149 | 1/1986 | Barzaro | 242/58.1 |
| 4,663,656 | 5/1987 | Elabd et al. | 358/75 |

FOREIGN PATENT DOCUMENTS

| | | | |
|---|---|---|---|
| 490023 | 1/1953 | Canada | 242/58 |
| 6052450 | 3/1985 | Japan | 242/58 |
| 95420 | 2/1960 | Norway | 242/58 |
| 1334704 | 10/1973 | United Kingdom | 242/58.1 |

OTHER PUBLICATIONS

German commercial bulletin DR 7201 "Frematic-Kantenregelungen" of Fa. Frede-Automatic KG, Düsseldorf, Germany, VDE-Nachrichten Feb. 5, 1962, p. 6.

ETZ-B, vol. 12, No. 18, May 9, 1696, p. 447.

*Primary Examiner*—Daniel P. Stodola

*Assistant Examiner*—John P. Darling

*Attorney, Agent, or Firm*—Herbert Dubno; Andrew Wilford

[57] ABSTRACT

A roll changer for delivering a web of material has, for edge-aligned connection of the trailing end of a delivered web with the leading end of the web from a new roll, in addition to the web edge-sensor controlling the position of the delivery roll during such delivery, a roll sensor responsive to the position of the edge of the outermost turn of the new roll, adjusting the axial position of the new roll. The sensors are switched to the respective controllers upon rotation of the roll turret to deliver a new roll to the waiting position.

8 Claims, 3 Drawing Sheets

APPARATUS FOR THE EDGE ALIGNED CONNECTION OF WEBS

FIELD OF THE INVENTION

Our present invention relates to improvements in an apparatus for the payout out of webs of flexible material, e.g. paper, cardboard, fabric, plastics or the like and, more particularly, to a control device for such apparatus or wherever connection of one web to another is desired, for the edge-aligned or edge-true connection of a controlling end of a web from a delivery roll to a leading end of a web from a new roll.

BACKGROUND OF THE INVENTION

It is known to provide, for example in a machine or mechanism for unrolling webs of material from rolls, a roll carrier rotatable about a roll axis for a delivery roll from which a web is drawn, and a roll carrier rotatable about an axis parallel to that of the roll carrier for receiving a new roll from which a web is to be subsequently drawn.

Each of the roll carriers is adjustable in the direction of the roll axis and for positioning in this direction can be provided with a respective servomechanism or positioning drive.

The positioning drives for the roll carriers of each roll in the position of a delivery roll are generally each provided with a sensor which monitors the position of the edge of the delivered web of material and provides an actual value or instantaneous value signal to the controller for that positioning drive.

In unwinding or paying out rolls of web material, it is known to control the position of the edges of the unrolling or delivered web, to detect position changes in the longitudinal edges of the web and to use the position deviation to adjust the positioning drive (see the German commercial bulletin DR 7201 "FREMATIC—Kantenregelungen" of Fa. Frede—Automatic KG, Dusseldorf, Germany, VDI-Nachrichten 02.05.62 Page 6, ETZ-B, Vol. 12, No. 18, 05.09.69, Page 447).

Control devices of the aforedescribed type are known in roll changers as well, in which the web-edge sensor is provided in combination with the controller and positioning drive for each roll as it becomes the payout or delivery roll to control the edge position of the delivery web. The new roll, in such cases, is found in a waiting position which enables the connection of the controller edge of the web of the delivery roll with the leading end of the web of the new roll.

The new roll, as well, can be axially prepositioned in its waiting position with the aid of the positioning drive of its roll carrier to minimize any time delay between connection of the new roll to the trailing end of the previously delivered web and to ensure that the longitudinal edges of both webs are as flush as possible with one another.

This prepositioning has been found to ensure a rather exact disposition of the outer edges of the innermost turns of the new roll with the longitudinal edges of the delivered web. Problems are encountered, however, when the turns of the new roll are offset from one another so that the outer turns are axially shifted relative to the inner turns either as a result of winding errors in the production of the roll or as a result of roll deformation during transport, storage, handling or the like.

Such axial deviations of the outer web turns with respect to the inner web turns are not noted by conventional control devices and result in a corresponding lateral shift when the trailing end of the delivered web is to be connected to the leading end of the new roll when its laterally offset outer web turns.

OBJECTS OF THE INVENTION

It is the principal object of the present invention, therefore, to provide an improved apparatus for the purposes described which can avoid the drawbacks of earlier systems and ensure a rapid edge-true or edge-aligned connection of the leading end of a web from a new roll with the trailing end of the web from a previous delivery roll.

It is a more specific object of the invention to provide an apparatus for the purposes described in which the problem of lateral offset of the outer web turns of a new roll from the inner web turns is obviated.

It is yet another object of the invention to provide a control device or system for a roll-changing machine, for example, which will allow webs to be connected in an edge-aligned manner even when the outer turns of the new roll are axially shifted relative to the inner turns thereof.

SUMMARY OF THE INVENTION

These objects and others which will become apparent hereinafter are attained, in accordance with the invention in a device for the edge-aligned connection of a trailing end of a web from a delivery roll to a leading end of a web of a new roll which comprises:

respective roller carriers for receiving the delivery roll and the new roll and enabling rotation of the rolls about respective mutually parallel axes;

respective positioning drives for axially shifting the carriers along the respective axes;

a delivery-roll controller connected to the positioning drive of the carrier for the delivery roll and having a web-delivery sensor responsive to a position of a longitudinal edge of the web from the delivery roll and providing an instantaneous value signal to the delivery-roll controller; and a new-roll controller connected to the positioning drive of the carrier for the new roll and having a sensor responsive to a position of a longitudinal edge of an outermost turn of the web of the new roll and providing an instantaneous value signal to the new-roll controller for adjusting a position of the carrier for the new roll in accordance with a difference in positions of the longitudinal edge of the delivery roll and the outermost turn, thereby aligning the longitudinal edges of the trailing end of the web from the delivery roll with the leading end of the web of the new roll, for edge-aligned connection of the ends.

According to a feature of the invention, the carriers form parts of a common roll changer in which the carriers are displaceable in a direction transverse to the axes along a path from a loading position in which a new roll is mounted on a carrier into a waiting position in which a new roll is prepared for delivery and then into a delivery position, the sensor responsive to the position of the longitudinal edge of an outermost turn being disposed along the path between the loading and waiting positions, both of the controllers and the positioning drives being connected to switch means for switching the controllers to the positioning drives selectively in dependence upon the positions or movement of the carriers along the path between the loading and waiting positions.

In the system of the invention, therefore, a roll sensor is provided for the new roll which detects the edge position of the outermost turn of the new roll and forms an actual value or instantaneous value input for a second controller part from the one used to position the delivery roll during delivery so that, in dependence upon the difference between the edge position of the delivery web and the edge position of the outer web turn of the new roll, the axial-positioning drive for the roll carrier of the new roll is shifted.

In the system of the invention, therefore, the axial positioning of the new roll is effected in accordance with the edge position of its outer web turns so that the outer web turns of the new roll, even in the case of an axial offset relative to the inner web turns, will always be edge-aligned with the web as it continues to be delivered from the other roll, namely, the payout roll or delivery roll and the connection between the webs can thus be made in an edge-aligned or flush relationship.

The positioning is effected by means of the roll sensor described and the controller and positioning drive of the roll carrier which at the particular time support the new roll and operating in the same way as the control circuit for the edge position of the web sensor and the controller and positioning drive for the roll carrier of the current delivery roll. The actual value or instantaneous value of the longitudinal edge of the delivery web or the setpoint value thereof from the other control circuit can provide the setpoint value for the control circuit of the new roll which is compared with the actual value supplied by the roll sensor. In both cases a lateral offset of the webs as they are approached to each other for connection is excluded.

When the invention is provided in a roll changer, the roll carriers can be mounted on a turret or rotating structure so that each roll carrier alternately or selectively is disposed at a loading position in which a new roll is loaded onto the respective carrier. The rolls and their carriers are displaced in a direction transverse to the roll axes over a portion of the paths which brings each new roll from its loading position into its waiting position.

The two controllers with their respective axial-positioning drives, respectively associated with the roll carriers, are connected with switching means so that during outer movement of the new roll from its loading position to its waiting position, the roll sensor responsive to the outer turns of the web is affected to control the position of the new roll while the other controller-positioning drive remains connected to the web sensor responsive to the delivery web.

The switching is thus effected in dependence upon the position or moves of the roll carrier along its path between the loading position and the waiting position and the controllers can be switched to the respective positioning drive accordingly.

The axial positioning of the new roll is therefore effected during its movement into the waiting position on a roll change and the web sensor and roll sensor control circuits are switched over in function so that each roll carrier is shifted by its positioning drive in response to one or the other sensor depending upon whether it is currently functioning as the delivery roll or as the new roll.

According to a preferred embodiment of the invention, along the path of each new roll from its loading position into its waiting position, a measuring position is provided and a signal generator is associated with this measuring position to output a signal when the new roll with its outer web turns reaches the measuring position. The signal generator is outputted to a memory or storage disposed between the roll sensor and its associated control circuit so that only the edge position detected by the roll sensor in the measuring position is stored as the significant value and fed to the controller.

Advantageously, the signal generator is formed as a light curtain, i.e. the combination of at least one light source providing a light beam which is intercepted by the roll, and a photo cell in the path of that light beam.

By the provision of this measuring position, we can ensure that the edge position of the outermost web winding or turn is always detected at the same place with respect to the fixed roll sensor and that the roll sensor need not be repositioned or movable although the new roll travels from its loading position into its waiting position. Furthermore, the edge position determination is not affected by the movement along the path or the diameter of the new roll.

Advantageously, the roll carriers are provided on diametrically opposite ends of a two-arm turret or roll "star" rotatable about a turret axis parallel to the axes of the roll carriers and the roll.

The web sensor and the roll sensor are each connected to an actual value/setpoint value comparator circuit and for both of these comparators a common setpoint value generator can be provided so that both controllers respond to the same setpoint value.

The web sensor and the roll sensor can preferably be constituted with CCD-column cameras. Such edge detectors can be of the type described, for example, in U.S. Pat. No. 4,663,656.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
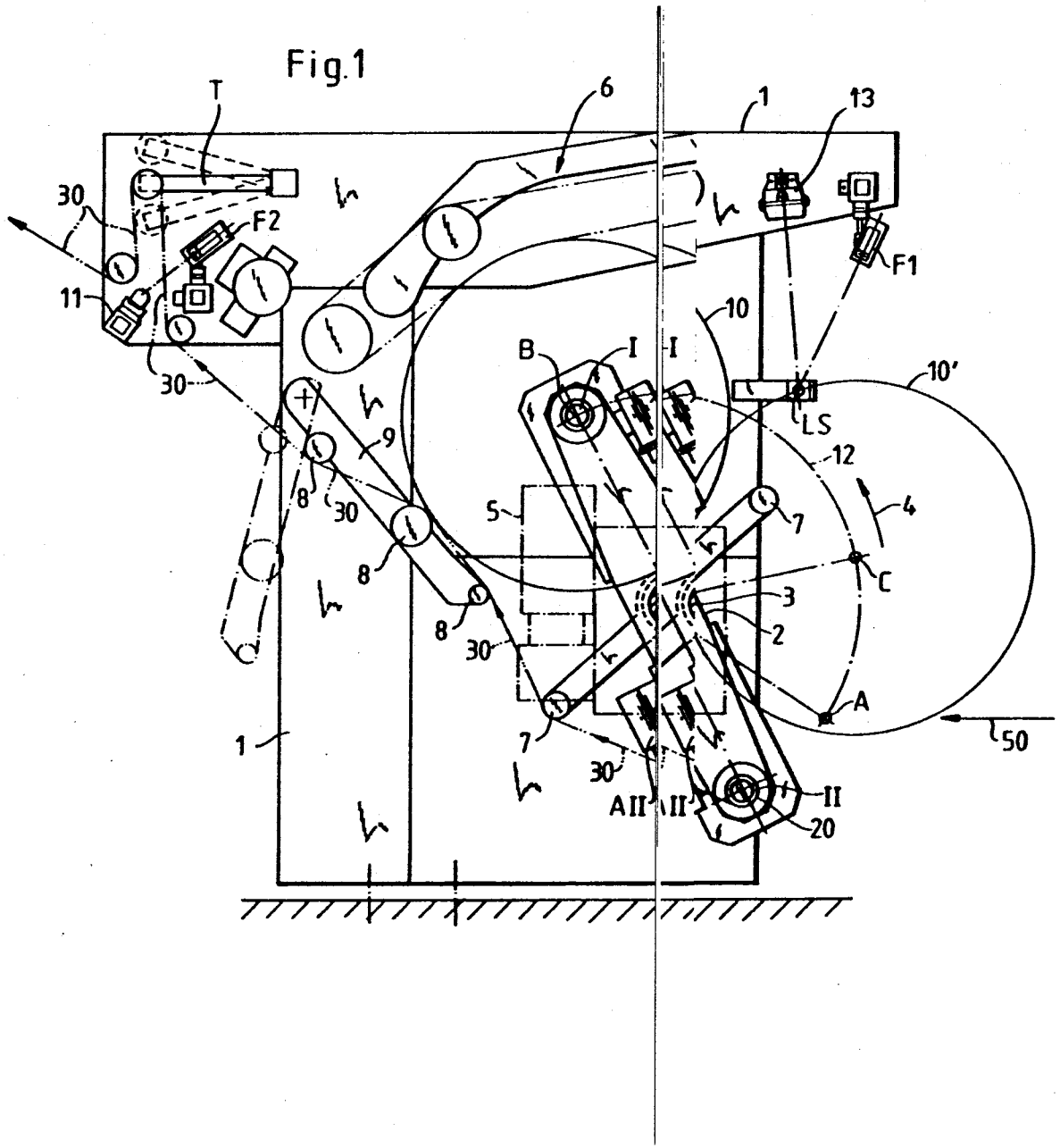
FIG. 1 is a side elevational view, partly in section, of a roll changer according to the invention.
Figure 2:
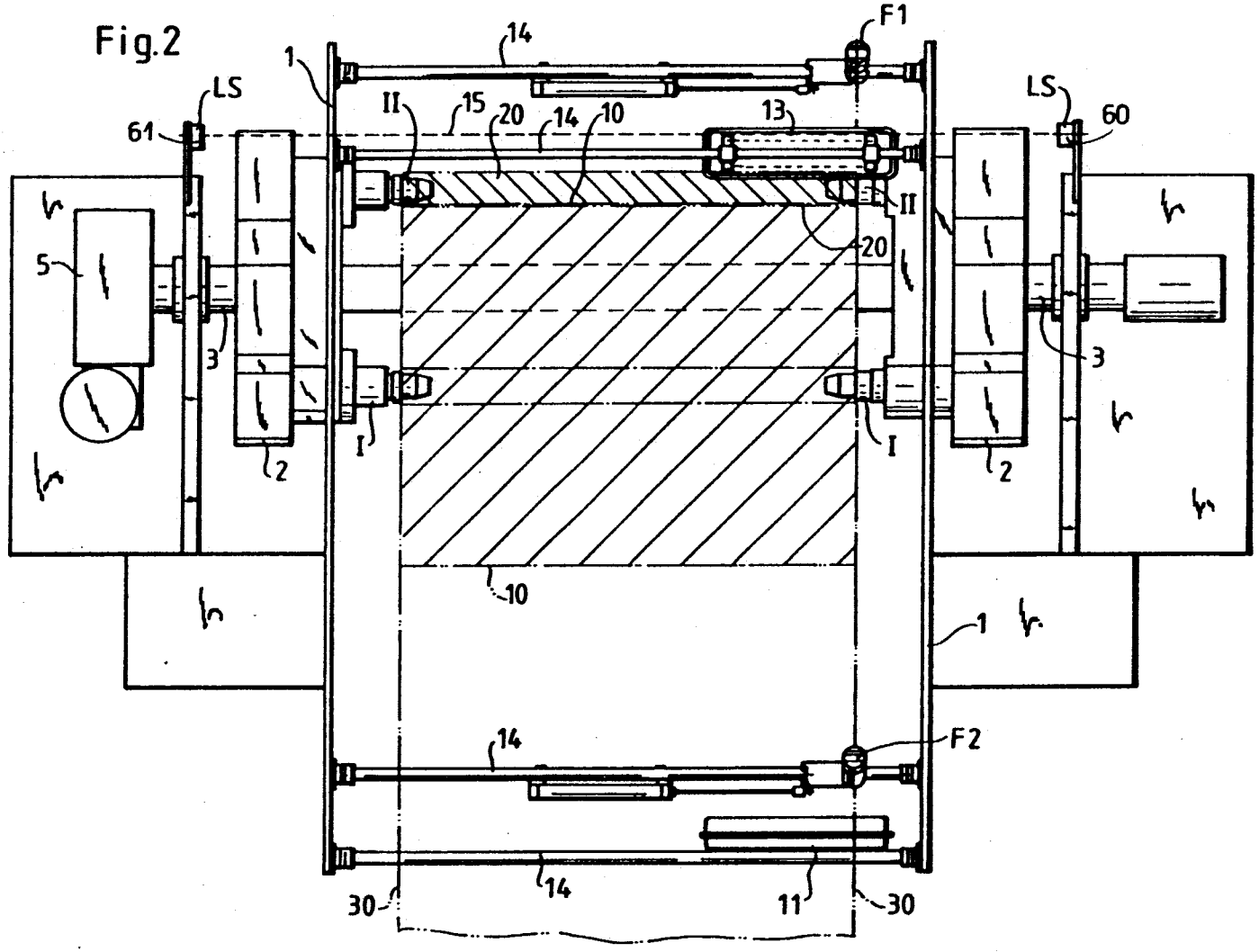
FIG. 2 is a plan view of the roll changer of FIG. 1 with the rolls being symbolized by cross-sectional hatching.

FIGS. 1 and 2 illustrate, in highly diagrammatic form, a roll changer for the feeding of webs from rolls of such webs and for the automatic connection of successive webs to one another upon a roll change.

The machine frame 1 carries a double-arm roll star or turret 2 rotatable about an axis 3 in the form of a shaft received in the machine frame. The rotation of the turret 2 in the sense represented by the arrow 4 (FIG. 1) is effected in accordance with a control program by a drive 5 for the shaft 3.

On the turret 2, two rolls 10 and 20 are rotatable about respective roll axes parallel to one another and to the shaft 3 on respective roll carriers I and II.

The roll carriers I and II can be formed as any conventional roll carriers for rolls of web material. For example, they can be constituted as clamping mandrels, expandable cones or the like and can be manually or power-actuated to engage and release the rolls.

By rotation of the turret 2, the roll carriers I and II are alternately positioned in a loading position or station A, in which a new roll can be inserted in the direction of arrow 50, and in a waiting position B (FIG. 1) by the movement along a circular path centered on the shaft 3.

A swingable belt assembly 6, having a controlled motor serves to accelerate and brake the roll 10 positioned in the waiting station B. This belt arrangement can be shifted toward the center of the roll so that different diameters of waiting new rolls can be accelerated or braked.

It will be appreciated that, for the attachment of the leading end of the new roll to the trailing end of the previously delivered or old roll 20, a new roll must be accelerated to the speed of the old roll so that the two rolls are synchronously rotated, at least as far as the respective peripheral speeds are concerned.

The web currently being delivered is represented at 30 and passes over a tensioning assembly T of conventional design.

From the delivery position shown at the lower right in FIG. 1, the delivery roll 20 can be seen to pay out the web 30 over a guide roller 7 and the feed rollers 8.

The gluing of the webs together is effected by a pressing arm 9 which can be swung from its dot-dash position seen in FIG. 1 into its solid-line position.

When the residual roll 20 has reached a predetermined minimum diameter, the pressing arm 9 urges the trailing end of the web 30 against the outermost turn of the web of the new roll 10 after an adhesive has been applied to the web 30 to thereby bond the trailing end of the web 30 with the web of the new roll. The web 30 is then cut from the residual roll 20 and the web from the new roll is drawn off. The residual roll 20 is removed from the roll carrier 2 which can be brought into the loading position A and a new roll 10 can be inserted into the roll carrier II.

With decreasing diameter of the roll in the roll carrier I, the turret 2 is rotated to bring the most recently introduced new roll from the loading position A into the waiting position B and the process can be repeated for successive rolls. The position of the roll changer is that of FIG. 1 with the sole exception that the roll carriers I and II are interchanged in position.

The roll carriers I and II on the turret 2 are shiftable along the respective roll axes. For this shifting action, each of the roll carriers I and II is provided with a respective positioning drive A I, A II.

In the orientation of the turret shown in FIG. 1, the positioning drive A II for the roll carrier II of the current delivery roll 20 is controlled in dependence upon the edge position of the delivered web 30.

For this purpose, a web sensor F2 is provided as an actual value sensor for a controller R2 which operates the positioning drive A II to restore a predetermined setpoint value to the edge position. This web sensor can be formed by a CCD-column camera (see U.S. Pat. No. 4,663,656) juxtaposed across the web with a light source 11 positioned along an edge of the web.

Along the path 12 of the roll carrier I or II of each new roll 10 from the loading position A into the waiting position B, a web sensor F1 detecting the position of the edge of the outermost web turn of the new roll 10 is provided. This web sensor F1 is also constituted as a CCD-column camera and is fixedly positioned on the machine frame 1 relative to the path of movement of the new roll 10. It cooperates with a light source 13 projecting a light detected by the CCD camera onto the edge of the outermost turn. In this construction the CCD camera and the light source 13 are located on the same side of the web.

The roll sensor F1 send an actual-value sensor or input to another controller R1 which, in dependence upon the difference between the detected edge position of the delivered web 30 and the detected edge position of the outer web turn of the new roll 10, shifts the axial positioning drive A I or A II for the roll carrier I or II for the respective new roll.

On the machine frame, in addition, are a light source 60 and a photo cell 61 forming a light curtain LS whose beam is symbolized at 15 for detecting arrival of the new roll at the measuring position represented at C in FIG. 1.

Figure 3:
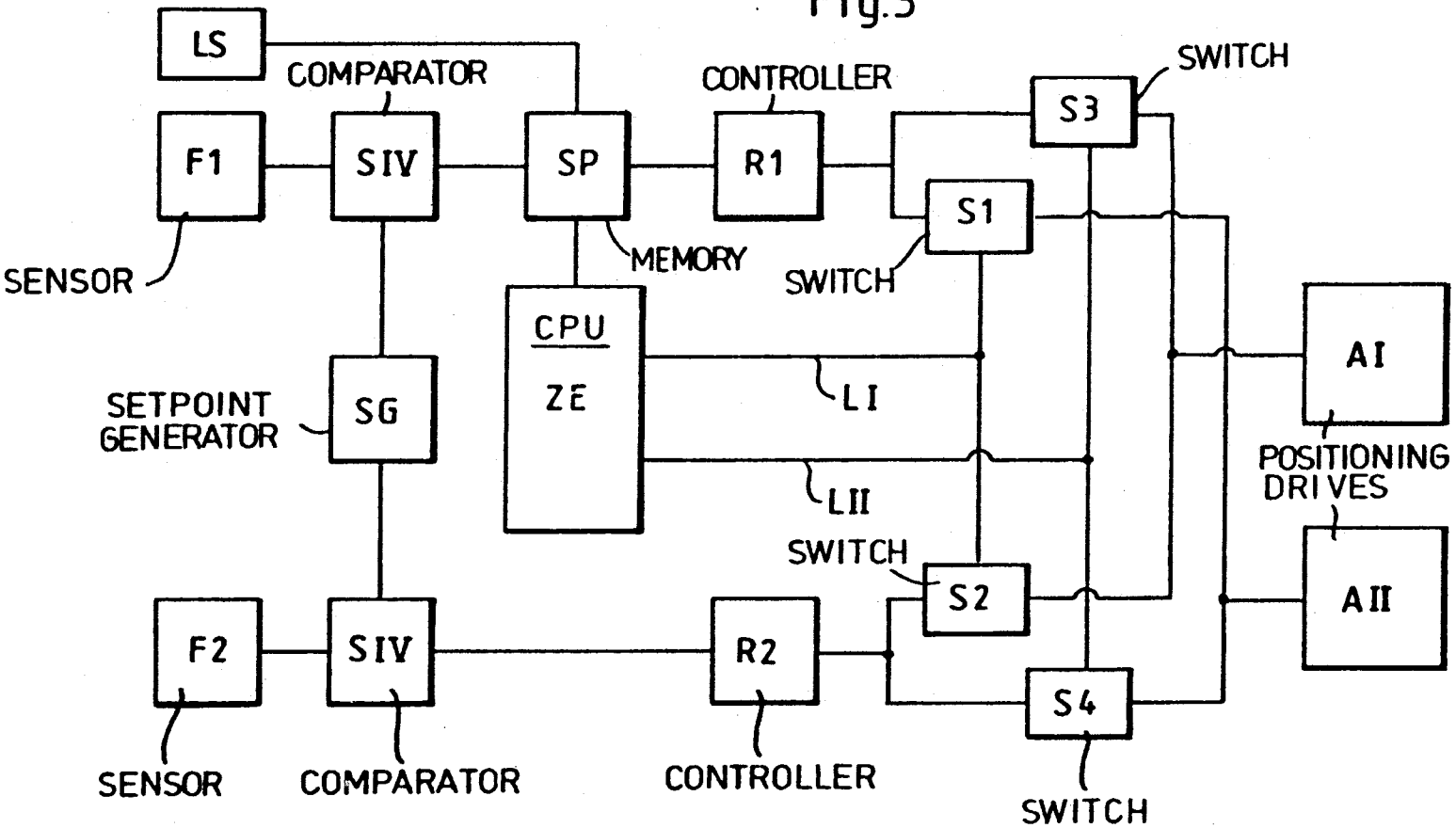
FIG. 3 is a block diagram of the web and roll-edge controllers for the roll changer of FIGS. 1 and 2.

As can be seen from FIG. 3, each of the sensors F1 and F2 provides an input to a respective comparator SIV. Both of these comparators SIV are supplied with the same setpoint value from a setpoint generator SG.

The outputs of the two controllers R1, R2 are applied to the inputs of the axial positioning drives A I, A II through switches S1, S2, S3, S4 whose switching states are determined by the position and/or movement of the roll carriers I, II along their path 12 between the loading position A and the waiting position B, thereby reversing the connection of the controllers R1 and R2 to these position drives alternatively.

The switches S1–S4 are controlled in response to the rotation of the turret by a central control unit ZE which may be a microprocessor-based controller.

As long as the delivery roll 20 continues to pay out its web 30 from the roll carrier II, its positioning drive A II will remain connected by the switch S4 with the controller R2 while the positioning drive A I of the other roll carrier I will remain connected through the switch S3 with the controller R1, the switches S1 and S2 being blocked.

Upon reversal of function, the positioning drive A1 is connected with the controller R2 by the switch S2 while the positioning A II is connected with the controller R1 by the switch S1.

The control signals are supplied by the central processor ZE through the lines $L_1$ and $L_{11}$ to the switches. The switches S1–S4 can be conventional gates which are blocked or unblocked depending upon the signal flow between the controllers R1 and R2 and the positioning drives A I and A II as determined by the CPU ZE.

The light sources 11, 13 and the CCD cameras of the sensors F2 and F1 are adjustable along traverses 14 of the machine frame so that they can be adjusted to various roll and web widths.

As previously indicated, along the path 12 of each new roll 10 from the loading position A to the waiting position B, a measuring position C is provided in which the new roll intercepts the light curtain LS shown as a broken line 15 in FIG. 2.

The light curtain LS thus provides a signal when the new roll 10 in the measuring position C and its outer turn 10' hits the beam 15 of the light curtain and thus is accurately positioned to allow the camera F1 to record the axial position of the edge of this outer turn. This measuring signal is then stored in the memory SP until the roll reaches its waiting position B, thereupon operating the controller R1 to properly position the new roll so that ultimately the outer turn will be in edge-alignment with the current delivered web 30.

The measuring position C ensure that the edge control for the new roll will utilize only a measurement signal in which the roll sensor F1 has an output independent upon the displacement and roll diameter of the new roll. The memory SP, of course, ensures that only the signal from the roll sensor F1 detecting the edge location at position C will be transmitted to the controller R1.

We claim:

1. In an apparatus for paying off a web from successive rolls, a device for the edge-aligned connection of a trailing end of a web from a delivery roll to a leading end of an outermost turn of a web of a new roll, the apparatus comprising:

respective roller carriers for said delivery roll and said new roll and enabling rotation of said rolls about respective mutually parallel axes;

respective positioning drives for axially shifting said carriers along the respective axes;

a delivery-roll controller connected to the positioning drive of the carrier for said delivery roll and having a web-delivery sensor responsive to a position of a longitudinal edge of said web from said delivery roll and providing an instantaneous value signal to said delivery-roll controller; and a new-roll controller connected to the positioning drive of the carrier for said new roll and having a sensor trained only upon the outermost turn of said new roll, responsive to a position of a longitudinal edge of the outermost turn of said web of said new roll, and providing an instantaneous value signal to said new-roll controller for adjusting a position of said carrier for said new roll in accordance with a difference in positions of said longitudinal edge of said delivery roll land said outermost turn of the new roll, thereby aligning the longitudinal edges of said trailing end of said web from said delivery roll with said leading end of said web of said new roll, for edge-aligned connection of said ends, said carriers forming parts of a common roll changer in which said carriers are displaceable in a direction transverse to said axes along a path from a loading position in which a new roll is mounted on a carrier into a waiting position in which a new roll is prepared for delivery and then into a delivery position, said sensor responsive to said position of said longitudinal edge of an outermost turn being disposed along said path between said loading and waiting positions, both of said controllers and said positioning drives being connected to switch means for switching said controllers to said positioning drives selectively in dependence upon the positions or movement of said carriers along said path between said loading and waiting positions.

2. The apparatus defined in claim 1 wherein along said path between said loading position and said waiting position each new roll is located at a measuring position provided with a signal generator generating a signal when each new roll with a respective outermost winding arrives at said measuring position, said apparatus comprising a memory connected to said sensor responsive to said position of said longitudinal edge of an outermost turn and controlled by said signal so that only the edge position of said sensor responsive to said position of said longitudinal edge of the outermost turn of a roll in the measuring position is stored and fed to the respective controller.

3. The apparatus defined in claim 2 wherein said signal generator includes a light curtain.

4. The apparatus defined in claim 1 wherein said carriers are provided diametrically opposite one another on opposite ends of a double-arm turret rotatable about a turret axis, constituting the changer, and controllably driven therearound.

5. The apparatus defined in claim 1 wherein said sensors are each input elements of respective actual value/setpoint value comparators forming parts of said controllers, said comparators having a common setpoint generator connected thereto.

6. The apparatus defined in claim 1 wherein said sensors are CCD-column cameras.

7. An apparatus for joining a leading end of an outermost turn of a web wound on a new roll to a trailing end of a web of a delivery roll, the apparatus comprising:

respective roller carriers for said delivery roll and the new roll supporting same for rotation about respective mutually parallel axes;

respective positioning drives on the carriers for axially shifting the respective rolls along the respective axes;

means for drawing the web off the delivery roll and displacing it along a path;

a delivery-roll controller having a web-delivery sensor positioned along the path and responsive to a position of a longitudinal edge of the web from the delivery roll and providing an instantaneous value signal corresponding to the sensed delivery-roll position;

a new-roll controller connected to the positioning drive of the carrier for the new roll and having a sensor trained only upon the outermost turn of the new roll in a predetermined position thereof and providing an instantaneous value signal corresponding to the sensed outermost-turn position;

control means connected to the controllers for axially shifting the carrier for the new roll in accordance with a difference in positions of the longitudinal edge of the delivery roll and the outermost turn of the new roll, thereby aligning the longitudinal edges of the trailing end of the web from the delivery roll with the leading end of the outermost turn of the web of the new roll; and means for adhering the leading end of the web of the new roll to the trailing end of the web of the delivery roll after edge alignment of the rolls by the control means.

8. The apparatus defined in claim 7, further comprising a roll changer provided with both of the carriers and rotatable to move the carriers successively from a loading position to a delivery position and through an intermediate measuring position; and sensor means for detecting entry of the outermost turn of the web of the new roll into the measuring position for operating the sensor of the new-roll controller.

* * * * *